US010486317B2

(12) United States Patent
Ulery, II et al.

(10) Patent No.: US 10,486,317 B2
(45) Date of Patent: Nov. 26, 2019

(54) ANGLING SUPPORT ATTACHMENT FOR HAIR CLIPPERS

(71) Applicants: David L. Ulery, II, Mt. Vernon, OH (US); Joseph D. Lowe, Mt. Vernon, OH (US)

(72) Inventors: David L. Ulery, II, Mt. Vernon, OH (US); Joseph D. Lowe, Mt. Vernon, OH (US)

( * ) Notice: Subject to any disclaimer, the term of this patent is extended or adjusted under 35 U.S.C. 154(b) by 0 days.

(21) Appl. No.: 14/600,713

(22) Filed: Jan. 20, 2015

(65) Prior Publication Data

US 2016/0207209 A1 Jul. 21, 2016

(51) Int. Cl.
*B26B 19/38* (2006.01)
*B26B 19/20* (2006.01)

(52) U.S. Cl.
CPC ..... *B26B 19/3813* (2013.01); *B26B 19/20* (2013.01)

(58) Field of Classification Search
CPC ..... B26B 19/3813; B26B 19/20
See application file for complete search history.

(56) References Cited

U.S. PATENT DOCUMENTS 4,751,781 A * 6/1988 Szymansky ..... B26B 19/3886 30/32
5,084,973 A 2/1992 Quayle
5,937,526 A 8/1999 Wahl
2004/0250429 A1* 12/2004 McCambridge ..... B26B 19/20 30/233.5
2014/0352158 A1* 12/2014 McCambridge ..... B26B 19/06 30/200

* cited by examiner

*Primary Examiner* — Omar Flores Sanchez

(57) ABSTRACT

A wedge with a predetermined angle is attached by various methods to a conventional hair dipper, in which the wedge supports the dipper at a particular angle as it slides across the cutting surface allowing a user to cut hair to a selected length based on the degree of the angle of the wedge.

1 Claim, 2 Drawing Sheets

ANGLING SUPPORT ATTACHMENT FOR HAIR CLIPPERS

CROSS REFERENCE TO RELATED APPLICATION

Provisional No. 61/965,076

STATEMENT REGARDING FEDERALLY SPONSORED RESEARCH OR DEVELOPMENT

Not Applicable

REFERENCE TO SEQUENCE LISTING

Not Applicable

BACKGROUND OF THE INVENTION

Hair clippers in use today with attached blades can be difficult to control with a steady hand. Conventionally clippers are held flat with their blades, (reciprocating top and fixed bottom blades) on top of the surface on which the hair grows. With the blades flat on top of the surface, the hair glides between the fixed blade and the reciprocating blade and is cut with relatively uniform length. Holding the clipper in this position allows for the user to stabilize the clippers and the blades to get an even cut. By positioning the blade against the flat surface, this stability reduces the sway and waiver of the clippers.

However, those skilled in the art may choose not to position the blade against the flat cutting surface in order to get a more feathered appearance, many will hold the clippers at an angle. However, holding the clippers as at angle creates an unstable void under the rear of the clipper blades and make it difficult to maintain the same angle over the entire cutting surface, especially where the cutting surface is not smooth.

By maintaining the blade in a consistent position allows for the user to get the most uniform cut with the least amount of imperfections. However, with traditional clipper shapes, the blades are positioned nearly parallel with the cutting surface. Since the reciprocating blades do not have the ability to self-clear, and being in a horizontal position, the cut hair has a tendency to accumulate in and on the cutting blade surface. This drawback associated with the clipper blades being horizontal to the cutting surface allows for the cutting surface to get clogged with cut hair that is channeled through the teeth of the blades which are easily obstructed with fine clippings. The obstruction of the blades with hair clipping prevents uncut hair to reach the cutting blade. This hair is by-passed since it sliding under the horizontal blades, uncut. Once again, the user would need to regularly clear out the blades from hair clipping as well as perform multiple passes over the same area to get a consistent and even cut. Clippers are sold with a blade cleaning brush that facilitates the removal of hair clipping clogs, but the amount of time that is needed to clear these clogs is inefficient.

There are currently comb attachments that can be attached to the clipper blades that can alter the length of the hair that is cut. These combs are chosen for lengths of hair that is much longer than the longest clipper blade can cut. These comb attachments guide hair toward the cutting blades, but because these combs attach to the blades, these attachments do not let the blade touch the cutting surface. However, this diminishes the cutting capacity of the blades; thus multiple passes are required to get a complete cut, but does result in an even cut length over the cutting surface.

SUMMARY OF THE INVENTION

The present invention relates generally to an angled support attachment or wedge for conventional hair clippers. More particularly, this wedge has a slidabe contact with the cutting surface, whereby the wedge supports the clippers held at a precise angle based on the wedge angle size chosen. The wedge angle size shall determine the adjustably tilted elevations of the clippers which is selected by the user for cutting the hair to a selected length. The wedge as stated will not require modification in any respect of the hair clippers on which it is mounted, and will not interfere with normal operation of the clippers or blades.

The combination of the cutting blades held at a prescribed angle determined by the wedge attachment allows for the user to keep the clipper resting on the cutting surface to allow for more control of the clippers, thus enabling the hair to be cut in fewer passes, with less damage, in an expedited fashion.

Appropriate angling of the blade produces a thatched, feathered, and more natural appearance to the finished cut hair. Managing the dippers with a consistent angle and keeping the front cutting edge isolated up on the cutting surface can be arduous without the proposed wedge. Adding the wedge to the dippers allows for the maintenance of a specific pre-determined angle based on the wedge angle size chosen by the user and enables consistency of the cutting length of the hair during operation of the clippers which ultimately improves the accuracy and quality of the finished haircut. Furthermore, the wedge allows the blade to more closely follow the contours of the cutting surface, yet does not allow the reciprocating blades to touch the cutting surface which lessens the pressure of the fine point of the blade on the cutting surface which minimizes discomfort for the subject whose hair is being cut and greatly reduces the opportunity for the cutting surface to be gouged or damaged in any way.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DESCRIPTION OF THE PREFERRED EMBODIMENT

Figure 1:
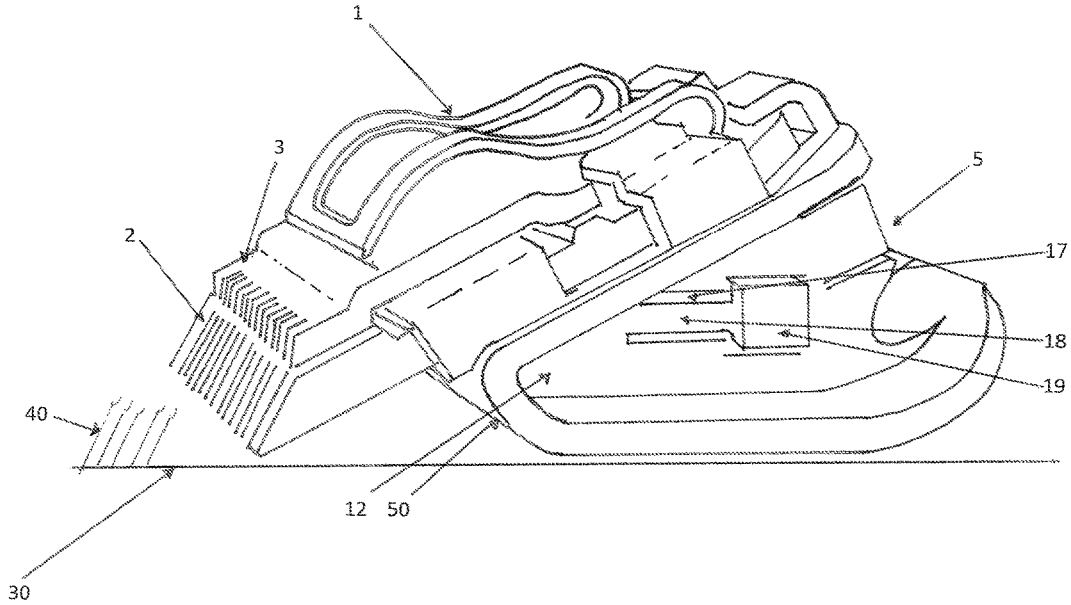
FIG. 1 is a side elevational view of conventional hair clipper blades, a wedge formed in accordance with the present invention being mounted thereon with tabs.
Figure 2:
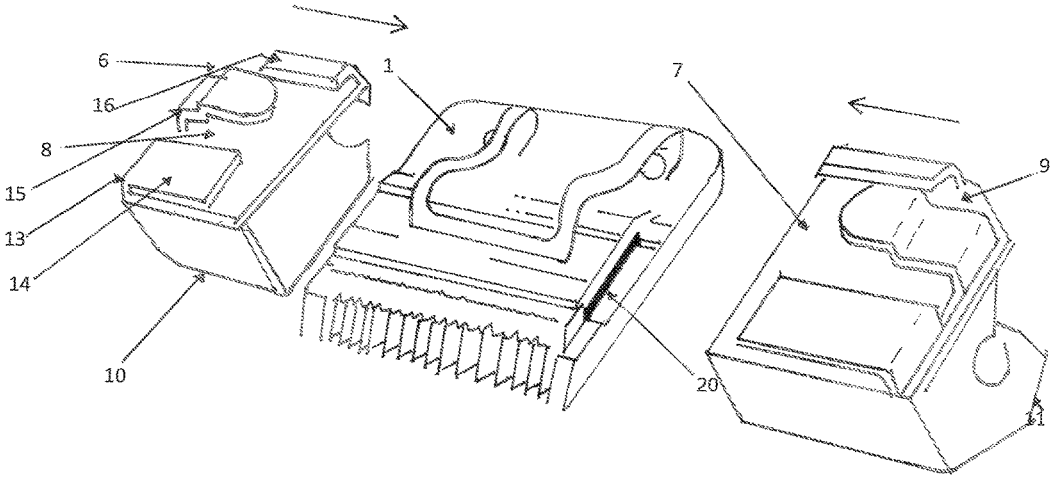
FIG. 2 is a top perspective view of the two-piece wedge in relation to the clipper blades.
Figure 3:
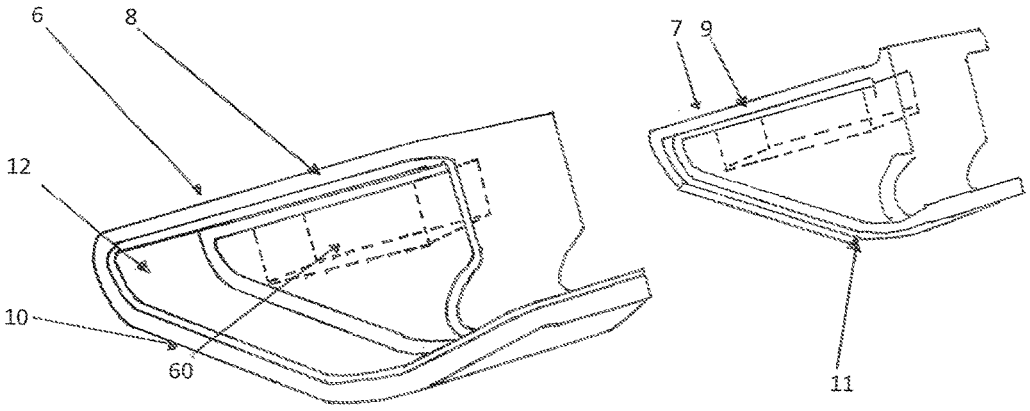
FIG. 3 is a elevational view of the wedge with the magnetic attachment.

Referring to the drawings in detail, depicts a conventional hair clipper 1 is provided with the bottom fixed blade 2 attached at the front end of the clipper 1 with the usual reciprocating blade 3 mounted above the bottom fixed blade 2 and having a space 20 between the two blades. On the underside of the clipper 1, the wedge 5 can be mounted. The hair clipper blade illustrated is a conventional example of one type of hair clipper on which the invention may be mounted.

Figure 4:
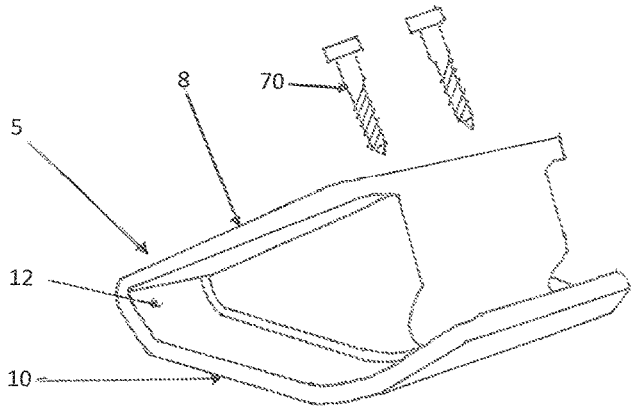
FIG. 4 is an elevational view with the screw attachment

The wedge 5 can be one piece (as shown in FIG. 4) or two pieces; the preferred embodiment is in two pieces. The wedge 5 is made up of a left portion 6 and a right portion 7 which are generally mirror images of each other. Each portion has a top side 8 and 9, respectively, a bottom side, 10 and 11, respectively, and a predetermined angle 12 in the range of 1 degree to 90 degrees formed at an apex 50. The bottom sides, 10 and 11, can easily slide or glide over a cutting surface 30, allowing for hair 40 to pass through the bottom fixed blade 2 and the reciprocating blade 3 to get cut. The uncut hair then passes under the bottom sides. The wedge 5 supports the clipper 1 at a selected angle 12 and retains the blades 2 and 3 at a desired elevation and angle relative to the cutting surface 30.

At the outside leading edge 13 of each top side of the portions is fixedly mounted is a front leading-edge tab 14, a rear leading-edge tab 15, and a back tab 16 which slide into the space 20 and frictionally grip the bottom fixed blade 2. The left portion 6 has a fixedly mounted protruding clip 17 which aligns with the receiving clip 18 on the right portion 7. The protruding clip 17 is inserted into the receiving clip 18 which secures the left portion and the right portion to form the wedge 5 as a whole. The user can depress the nodule 19 on the protruding clip to release the protruding clip from the receiving clip which will release the left and right portions which can then be removed from the bottom fixed blade.

There are various attachment mechanisms that would allow the wedge to remain as a fixed, but removable, attachment to the clipper besides the frictional gripping of the portions by the tabs mentioned above. Limiting movement of the wedge upon the clippers is paramount. Other attachment mechanisms could include magnets, screws, hook and loop material, or any other suitable manner.

It is to be noted that with the attachment of the wedge 5 to the clippers 1, the bottom fixed blade 2 and reciprocating blade 3 is disposed in a downward direction toward the cutting surface 30 forming a constant angle 12 as long as the bottom side of the wedge is sliding along the cutting surface whereby the blades of the clipper is positioned close to, but nevertheless spaced above, the cutting surface so as to cut the hair to a uniform, length.

The foregoing description is for purposes of illustration only and is not intended to limit the scope of protection accorded this invention. The scope of protection is to be measured by the claims, which should be interpreted as broadly as the inventive contribution permits. The wedge 5 can also be attached to the clipper 1 by a magnet 60. The wedge 5 can also be attached to the bottom fixed blade 2 by penetrating screws 70.

Although exemplary embodiments of the invention have been shown and described, many changes, modifications and substitutions may be made by one having ordinary skill in the art without necessarily departing from the spirit and scope of this invention.

The invention claimed is:

1. A wedge for a hair clipper comprising:

a first section and a second section, wherein each section having a top side, a bottom side, and an apex section that connects the top side and bottom side at a predetermined acute angle to maintain the hair clipper at a cutting angle;

each top side having an outside leading edge having four sides, wherein a front tab and rear tab are fixedly mounted on the same side and a back tab is fixedly mounted on a different side; wherein the front, rear and back tabs are configured to slidably engage with opposite sides of the hair clipper to fixedly attach each top side to the hair clipper;

each bottom side having a guiding surface configured to glide on a cutting surface;

a protruding clip fixedly mounted on the first section between the top and bottom sides;

a receiving clip fixedly mounted on the second section between the top and bottom sides;

wherein, when the first section and second section are mounted onto the hair clipper, the protruding clip is configured to be inserted into the receiving clip to secure the first and second sections together.

* * * * *